US010605449B2

(12) United States Patent
Lee

(10) Patent No.: US 10,605,449 B2
(45) Date of Patent: Mar. 31, 2020

(54) HOT WATER SUPPLY APPARATUS USING ROTARY MAGNETIC BODY

(71) Applicants: Young Taek Lee, Seoul (KR); CRITICAL FACILITY SERVICE CORPORATION, Seoul (KR)

(72) Inventor: Young Taek Lee, Seoul (KR)

(73) Assignee: CRITICAL FACILITY SERVICE CORPORATION, Seoul (KR)

( * ) Notice: Subject to any disclaimer, the term of this patent is extended or adjusted under 35 U.S.C. 154(b) by 241 days.

(21) Appl. No.: 15/573,551

(22) PCT Filed: May 11, 2016

(86) PCT No.: PCT/KR2016/004928
§ 371 (c)(1),
(2) Date: Nov. 13, 2017

(87) PCT Pub. No.: WO2016/182339
PCT Pub. Date: Nov. 17, 2016

(65) Prior Publication Data

US 2018/0180278 A1 Jun. 28, 2018

(30) Foreign Application Priority Data

May 13, 2015 (KR) ..... 10-2015-0066709

(51) Int. Cl.
*F22B 3/06* (2006.01)
*F24H 1/24* (2006.01)
(Continued)

(52) U.S. Cl.
CPC ..... *F22B 3/06* (2013.01); *F24H 1/14* (2013.01); *F24V 99/00* (2018.05)

(58) Field of Classification Search
CPC ..... F24V 40/00; F24V 40/10; F24V 99/00; F22B 3/06; F24H 1/14
See application file for complete search history.

(56) References Cited

U.S. PATENT DOCUMENTS 4,721,066 A * 1/1988 Newman, Sr. ..... F24V 40/00 122/26
6,011,245 A * 1/2000 Bell ..... F28D 15/02 219/631
(Continued)

FOREIGN PATENT DOCUMENTS

KR 10-0459260 B1 12/2004
KR 20-0404663 Y1 12/2005
(Continued)

*Primary Examiner* — Steven S Anderson, II
(74) *Attorney, Agent, or Firm* — KORUS Patent, LLC; Seong Il Jeong

(57) ABSTRACT

The present invention relates to an apparatus for supplying hot water and, more particularly, to a hot water supply apparatus using a revolving magnetic body, wherein the apparatus is driven with low power consumption while being environment-friendly and having excellent safety when hot water and heating are supplied, the apparatus including: a heat exchange body containing water, and including a circular heating pipe circumferentially provided in the heat exchange body; a stator provided to encompass an outside of the heat exchange body and wound with a plurality of coils, the stator being magnetized when an electric current is applied thereto, wherein the heating pipe includes therein a magnetic body that revolves along the circumference of the heating pipe due to a magnetic field formed by the stator, so that water is heated by frictional heat generated when the magnetic body revolves.

12 Claims, 9 Drawing Sheets

(51) Int. Cl.
*F24V 99/00* (2018.01)
*F24H 1/14* (2006.01)

(56) References Cited

U.S. PATENT DOCUMENTS

| | | | | |
|---|---|---|---|---|
| 6,016,798 | A * | 1/2000 | Selivanov | B01J 19/008 126/247 |
| 2005/0051111 | A1* | 3/2005 | Thoma | F24V 40/00 122/26 |
| 2006/0007656 | A1* | 1/2006 | Symons | H01L 23/473 361/699 |
| 2008/0056883 | A1* | 3/2008 | Lee | F04D 3/02 415/72 |
| 2009/0256443 | A1* | 10/2009 | Turner | H02K 7/1876 310/179 |
| 2019/0264954 | A1* | 8/2019 | McKie | F22B 3/06 |

FOREIGN PATENT DOCUMENTS

| | | | |
|---|---|---|---|
| KR | 10-2009-0079421 | A | 7/2009 |
| KR | 10-0917811 | B1 | 9/2009 |
| KR | 10-2012-0074170 | A | 7/2012 |

* cited by examiner

HOT WATER SUPPLY APPARATUS USING ROTARY MAGNETIC BODY

TECHNICAL FIELD

The present invention relates generally to an apparatus for supplying hot water and, more particularly, to a hot water supply apparatus using a revolving magnetic body, the apparatus being driven with low power consumption while being environment-friendly and having excellent safety.

BACKGROUND ART

In general, a boiler used as an apparatus for supplying hot water is installed in homes, buildings, and various facilities to supply hot water or heating in the seasons, and includes various kinds of boilers such as a small boiler used in homes, and a large boiler used in various facilities.

Such a boiler usually supplies hot water or heating to users by burning fuel energy such as gas, petroleum, light oil or the like to heat water. Herein, a heat exchange body of the boiler directly burns fuel such as gas or petroleum, heats water by using heat energy generated during burning, and discharges exhaust gas generated during burning to the outside through an externally installed chimney.

The above-described apparatus for supplying hot water is problematic in that exhaust gas is generated due to the use of fuel, and it may lead to an explosion accident, thereby posing a problem in safety.

Documents of Related Art (Patent Document 1) Korean Patent Application Publication No. 10-2009-0033424 (The boiler with wind power heating type heater)

DISCLOSURE

Technical Problem

Accordingly, the present invention has been made keeping in mind the above problems occurring in the related art, and an object of the present invention is to provide a hot water supply apparatus using a revolving magnetic body, the apparatus being driven with low power consumption while being environment-friendly and having excellent safety when hot water and heating are supplied.

Technical Solution

In order to accomplish the above object, the present invention provides a hot water supply apparatus using a revolving magnetic body, the apparatus including: a heat exchange body containing water, and including a circular heating pipe circumferentially provided in the heat exchange body; a stator wound with a plurality of coils to encompass an outside of the heat exchange body, and magnetized when an electric current is applied thereto, wherein the heating pipe includes therein a magnetic body that revolves along the circumference of the heating pipe due to a magnetic field formed by the stator, so that water is heated by frictional heat generated when the magnetic body revolves.

Advantageous Effects

As described above, according to the present invention, water is heated using the frictional heat generated when the magnetic body revolves along the circumference of the heating pipe due to the magnetic field formed by the magnetized stator rather than using any fuel, so it is possible to realize safety and an environment-friendly effect when hot water and heating are supplied. In addition, it is the magnetic body provided in the heating pipe to be actually affected by the magnetic field, so it is possible to realize driving with low power consumption.

BEST MODE

The present invention relates to an apparatus for supplying hot water and, more particularly, to a hot water supply apparatus using a revolving magnetic body, wherein the apparatus is driven with low power consumption while being environment-friendly and having excellent safety when hot water and heating are supplied, the apparatus including: a heat exchange body containing water and including a circular heating pipe circumferentially provided in the heat exchange body; and a stator wound with a plurality of coils to encompass an outside of the heat exchange body, and magnetized when an electric current is applied thereto, wherein the heating pipe includes therein a magnetic body that revolves along the circumference of the heating pipe due to a magnetic field formed by the stator, whereby water is heated by frictional heat generated when the magnetic revolves.

Before the present invention is described in detail, it should be noted that the scope of the present invention is not limited to the embodiments described below, and those skilled in the art will appreciate that various modifications, additions and substitutions are possible, without departing from the scope and spirit of the invention.

Hereinafter, the apparatus for supplying hot water using the revolving magnetic body of the present invention will be described in detail with reference to FIGS. 1 to 9.

Figure 1:
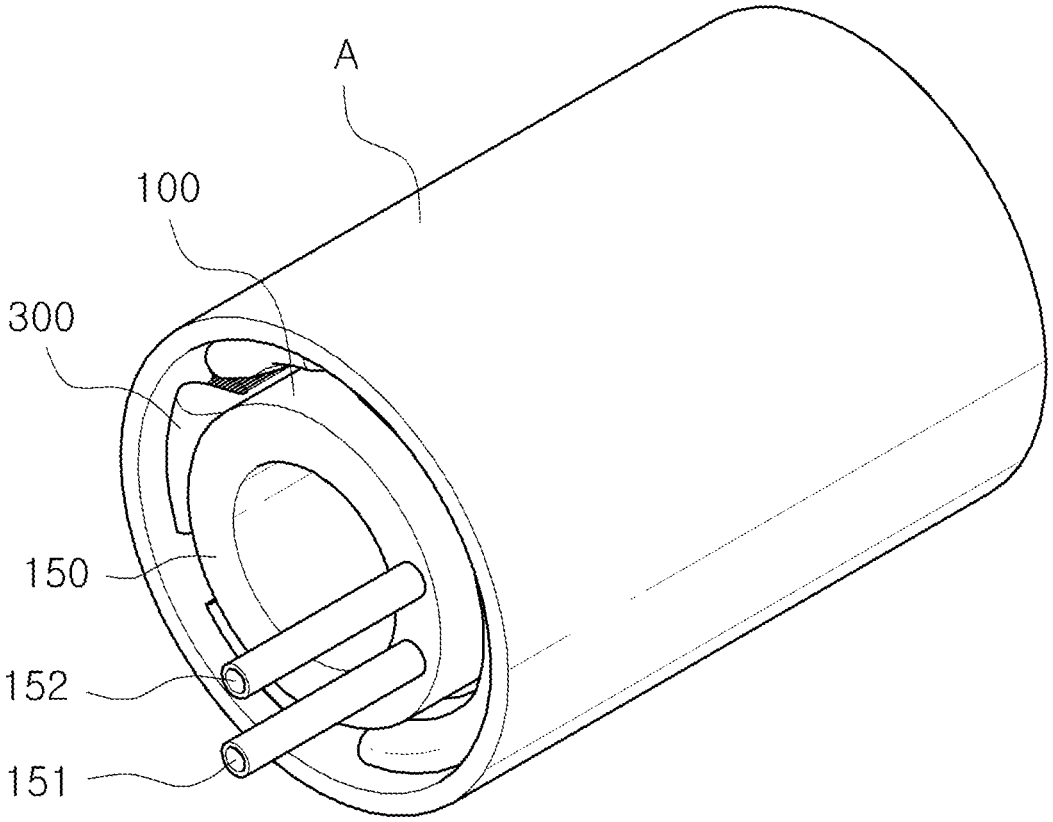
FIG. 1 is a perspective view showing an overall structure of an apparatus for supplying hot water according to the present invention.
Figure 2:
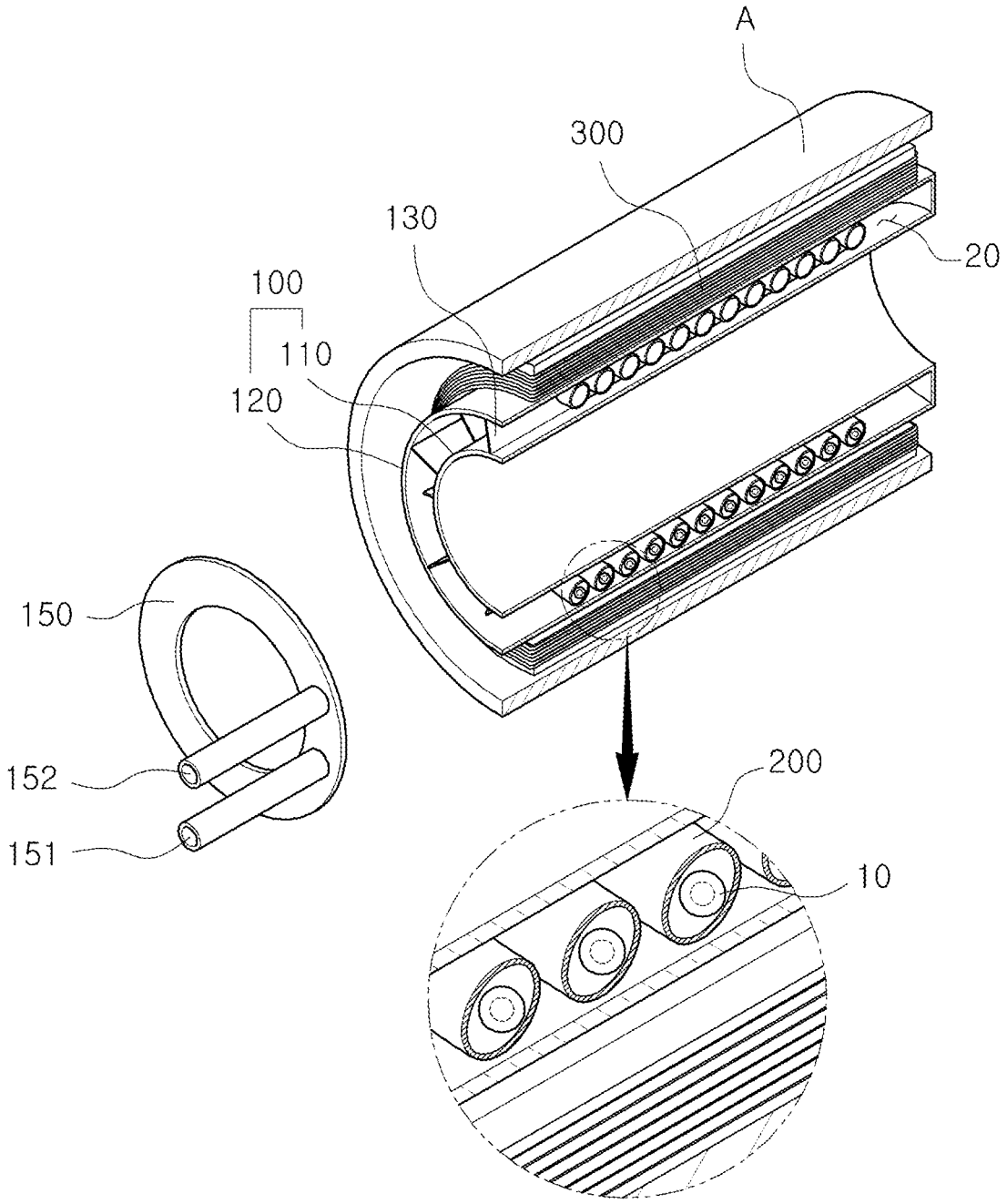
FIG. 2 is a partial perspective view showing an internal structure of the apparatus for supplying hot water according to the present invention.
Figure 3:
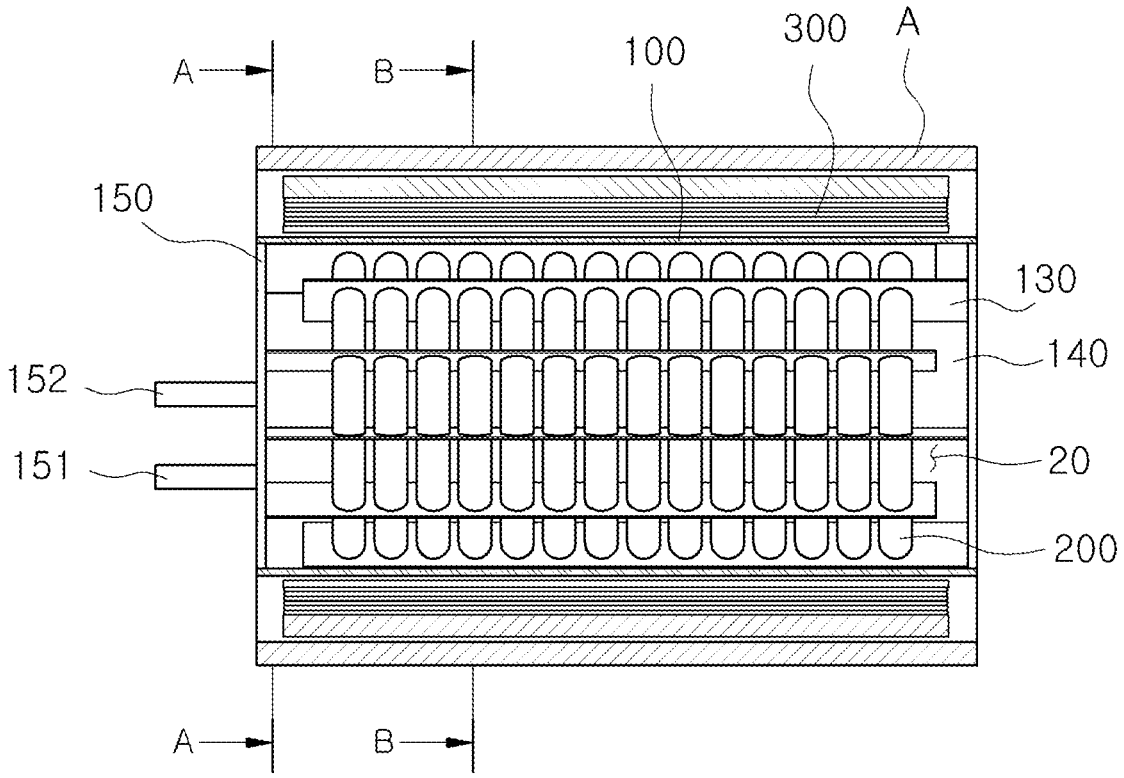
FIG. 3 is a side cross-sectional view showing the internal structure of the apparatus for supplying hot water according to the present invention.

As shown in FIGS. 1 to 3, the apparatus for supplying hot water using the revolving magnetic body includes the heat exchange body 100 provided therein with the heating pipe 200 and containing water, and the stator 300 provided to encompass the outside of the heat exchange body 100, wherein the heating pipe 200 is provided therein with the magnetic body 10.

More specifically, the heat exchange body 100 and the heating pipe 200 may have various shapes. However, as shown in the drawing, the heat exchange body 100 may have a cylindrical shape, and the heating pipe 200 may have a circular shape and may be circumferentially provided in the heat exchange body 100 such that the magnetic body 10 provided in the heating pipe 200 revolves along the circumference thereof. Further, the heat exchange body 100 and the heating pipe 200 may be made of a material such as copper, aluminum, etc. having diamagnetic properties, so as to be prevented from influence from a magnetic field. Hereinafter, this will be described on the basis of this premise.

Figure 4:
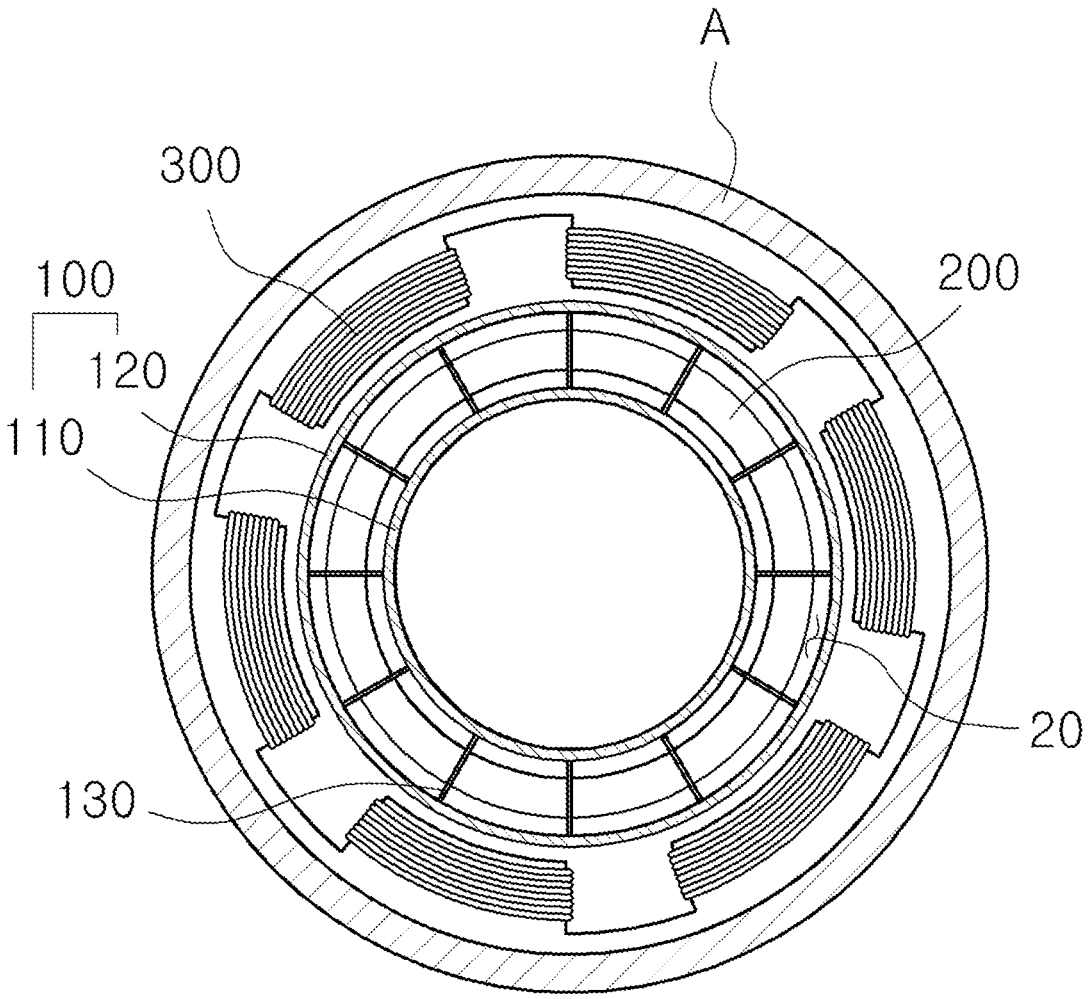
FIG. 4 is a cross-sectional view taken along a line A-A showing the internal structure of the apparatus for supplying hot water according to the present invention.
Figure 5:
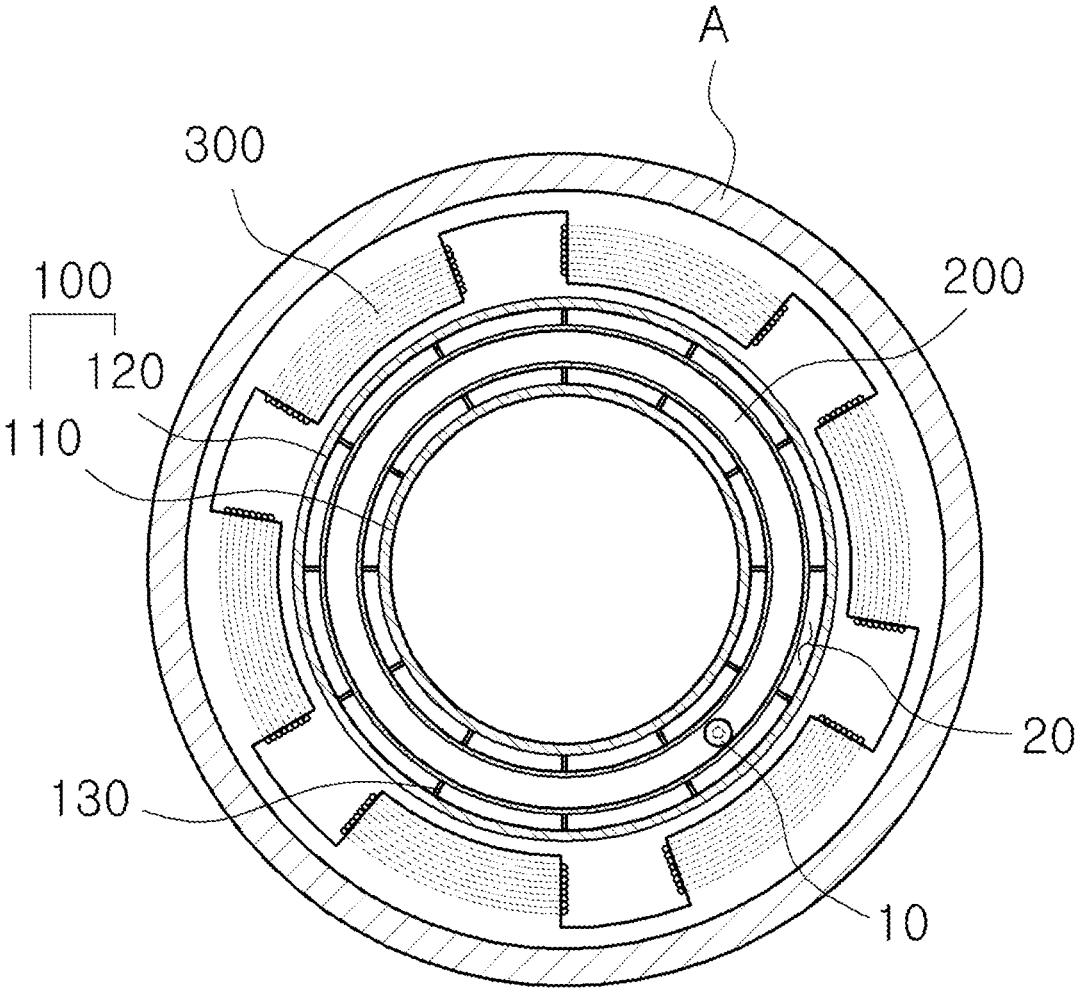
FIG. 5 is a cross-sectional view taken along a line B-B showing the internal structure of the apparatus for supplying hot water according to the present invention.

The stator 300 is wound with the plurality of coils, and is magnetized and forms a magnetic field when a current is applied thereto. The stator 300 may be provided on an inner surface of a housing A including therein the heat exchange body 100 and the stator 300. Specifically, as shown in FIGS. 4 and 5, a plurality of stator cores protruding inward to encompass the outside of the heat exchange body 100 is provided on the inner surface of the housing A, and the respective stator cores are wound with the coils to constitute the stator 300. In addition, the stator 300 may not be in contact with the heat exchange body 100.

The magnetic body 10 may have ferromagnetic properties and thus revolves along the circumference of the heating pipe 200 due to the magnetic field formed by the stator 300. The heating pipe 200 is heated by frictional heat generated when the magnetic body 10 revolves and thus friction occurs, and water that is in contact with or contained in the vicinity of the heating pipe 200 is heated by the frictional heat. Accordingly, the heating pipe 200 may be made of a material having a high thermal conductivity. Meanwhile, the water may be contained in the heating pipe 200 without flowing in and out, and as shown in FIGS. 1 to 3, may flow in and out through an inlet 151 and an outlet 152 that are provided at a cover 150 hermetically sealing the heat exchange body 100.

As described above, since the present invention uses the frictional heat generated by the magnetic body 10 revolving, it is possible to heat water without using any fuel, thereby being environment-friendly, and to ensure safety in supplying heated water, that is, hot water to users and in supplying heating using hot water. In addition, since it is the magnetic body 10 provided in the heating pipe 200 to be actually affected by the magnetic field, it is possible to realize driving with low power consumption.

Meanwhile, the heating pipe 200 may include therein a viscous fluid having viscosity such as oil such that the magnetic body 10 can efficiently revolve along the circumference of the heating pipe 200. The viscous fluid may include solid particles such as iron oxides such that the solid particles are caused to collide with friction particles during revolving of the magnetic body 10, thereby increasing frictional heat.

The viscous fluid may use a material that is easy to use for lubrication and heat transfer. For example, a heating medium oil, which is a synthetic oil used for heat transfer such as heating, heat removal, etc., may be used.

Figure 6:
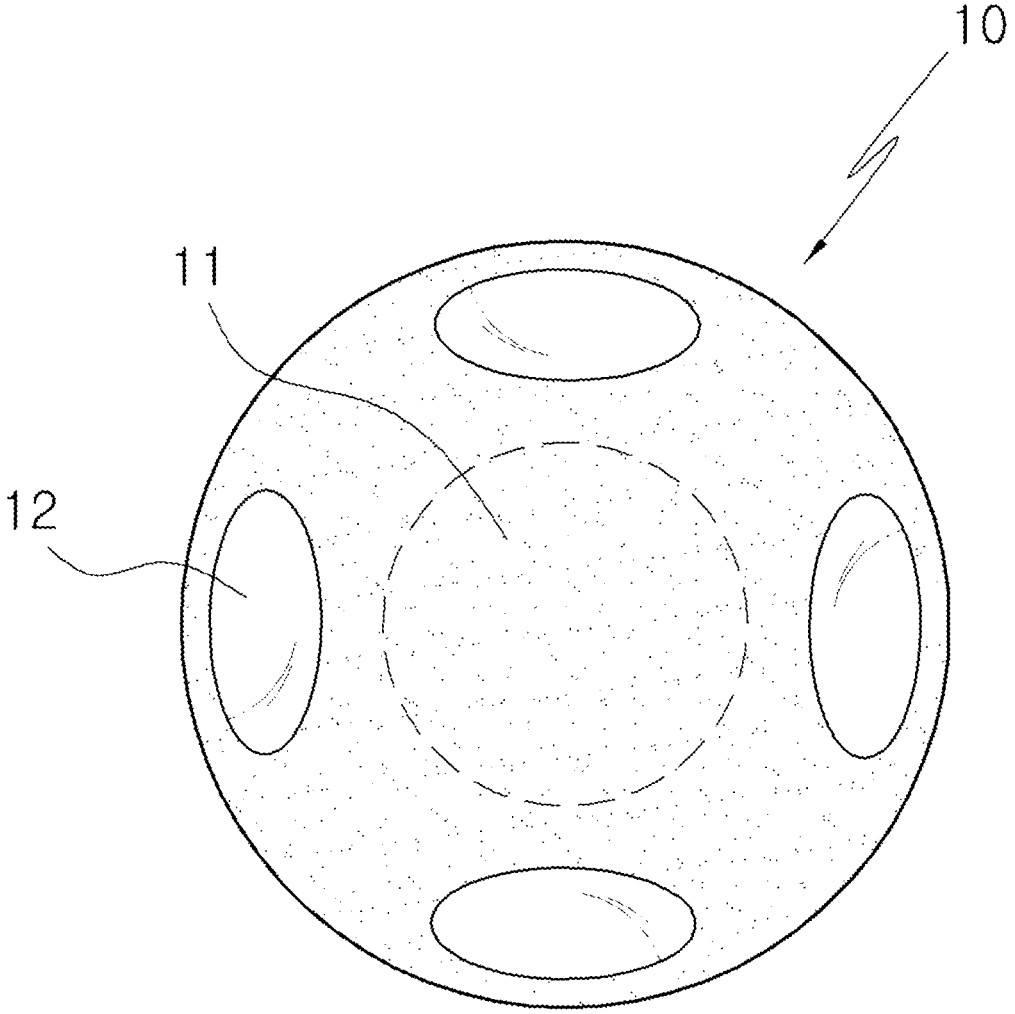
FIG. 6 is an exemplary view showing an embodiment of a magnetic body structure applied to the apparatus for supplying hot water according to the present invention.

The magnetic body 10 may be entirely made of a material having ferromagnetic properties, and as shown in FIG. 6, may be structured such that the core 11 having ferromagnetic properties is included therein, and a plurality of holes 12 is formed in a protective film encompassing the core 11, and thus a vortex may be formed in the viscous fluid. In addition, a plurality of vanes may protrude outwardly from the protective film and thus a vortex may be formed in the viscous fluid. Moreover, the protective film may be made of a material such as silicon or plastic, through which a magnetic force can pass.

Meanwhile, as shown in FIGS. 2 to 5, the heat exchange body 100 may include an inner cylinder 110 and an outer cylinder 120 positioned outside the inner cylinder 110, such that water is contained between the inner and outer cylinders 110 and 120 and the heating pipe 200 is provided therebetween. Accordingly, the contact area of the contained water with the heating pipe 200 can be increased, thereby achieving improved efficiency of the apparatus for supplying hot water according to the present invention. In addition, a plurality of heating pipes 200 may be arranged in the lengthwise direction of the heat exchange body 100, such that the contained water is heated by the plurality of heating pipes 200 in a short time.

Further, as shown FIGS. 3 to 5, a partition wall 130 is provided between the inner and outer cylinders 110 and 120 in the lengthwise direction of the heat exchange body 100 to define a heating flow passage 20 through which water flows in the heat exchange body 100. A plurality of partition walls 130 may be arranged in the circumferential direction of the heat exchange body 100 to define a plurality of heating flow passages 20. Water may be contained in the respective heating flow passages 20 without flowing in and out, and may be contained in the heating flow passages 20 provided with an inlet 151 and an outlet 152 communicating therewith, respectively. Consequently, by provision of the partition wall 130, it is possible to realize a structure where the contact area between the heating pipe 200 and water is maximized.

Figure 7:
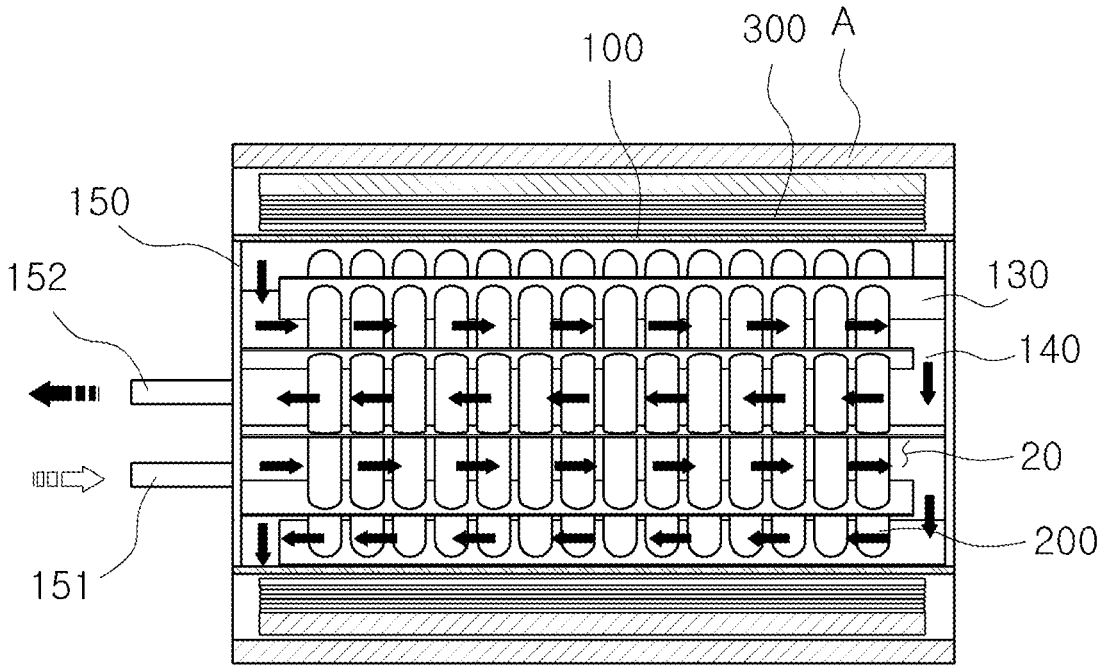
FIG. 7 is an exemplary view showing flow of water in the apparatus for supplying hot water according to the present invention.

Moreover, as shown in FIG. 3, the partition walls 130 may be provided with circulation holes 140, respectively such that water is allowed to flow to the adjacent heating flow passage 20. Accordingly, water can be gradually heated while being brought into contact with more heating pipes 200. The circulation holes 140 may be provided alternately at a first end of each of the partition walls 130 and a second end of an adjacent partition wall such that the maximum amount of inflowing water can be continuously heated until flowing out, thereby realizing a structure of water circulation. This is shown in FIG. 7, and water flowing into a certain heating flow passage 20 through the inlet 151 flows to the adjacent heating passage 20 through the circulation hole 140, and circulates in the lengthwise and circumferential directions of the heat exchange body 100, and then flows out through the outlet 152. In this case, a certain partition wall 130 that is positioned between the heating flow passage 20 communicating with the inlet 151 and the heating flow passage 20 communicating with the outlet 152 may be provided with the circulation hole 140 such that a part of water flows out to the outside and remaining water continues to circulate. On the other hand, the partition wall may be provided with no circulation hole 140 such that water circulates in the circumferential direction of the heat exchange body 100 in only one cycle.

Meanwhile, although not shown in the drawing, a plurality of heat exchange bodies 100 may be provided inside the stator 300. Herein, a first one of the heat exchange bodies 100 may have a different radius from a second one of the heat exchange bodies 100 such that the second heat exchange body 100 is placed inside the first exchanger 100. Since the magnetic body 10 must revolve along the outer circumference of the heating pipe 200, each of the plurality of heat exchange bodies 100 may be provided within the range of the magnetic field formed by the stator 300.

Figure 8:
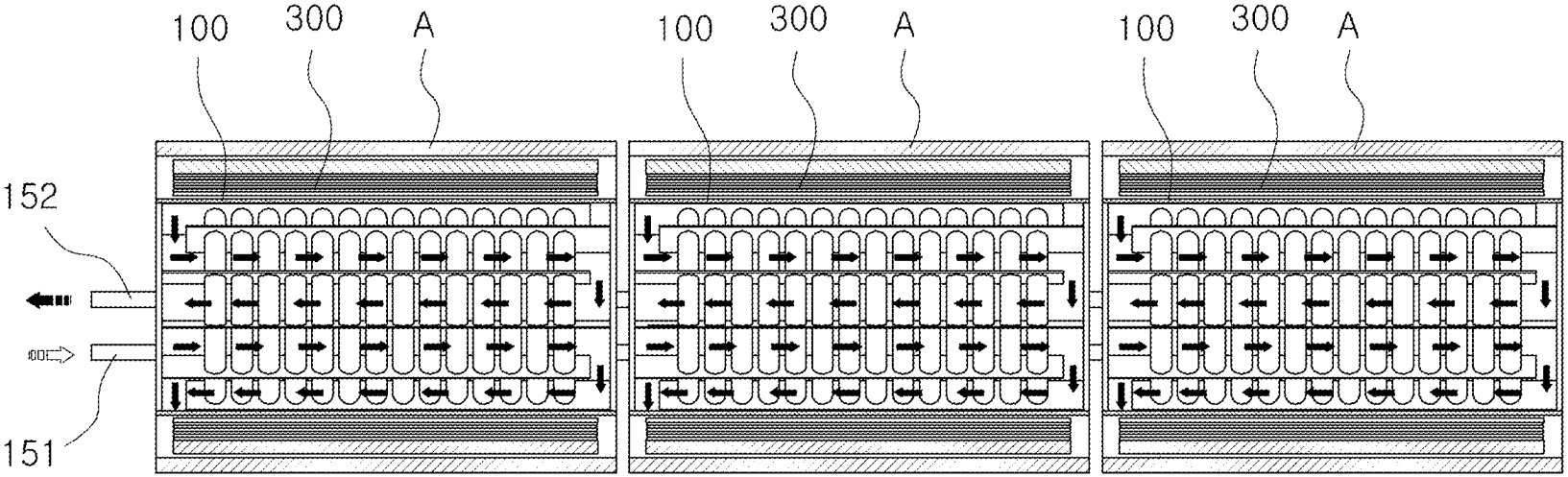
FIGS. 8 and 9 are views showing another embodiment of the apparatus for supplying hot water according to the present invention.

Further, as shown in FIG. 8, a plurality of apparatuses for supplying hot water using the revolving magnetic body according to the present invention may be provided. Herein, the inlet 151 and the outlet 152 provided at a first apparatus for supplying hot water are connected to a second apparatus for supplying hot water, whereby water can be continuously circulated and heated. Accordingly, it is possible to supply hot water and heating over a wide area.

Further, the present invention may include a rotor 400 including a plurality of permanent magnets, and the rotor 400 is rotated by a shaft 500 provided to pass through the heat exchange body 100 in the lengthwise direction thereof. Herein, the heat exchange body 100 and the rotor 400 are placed inside the stator 300.

Figure 9:
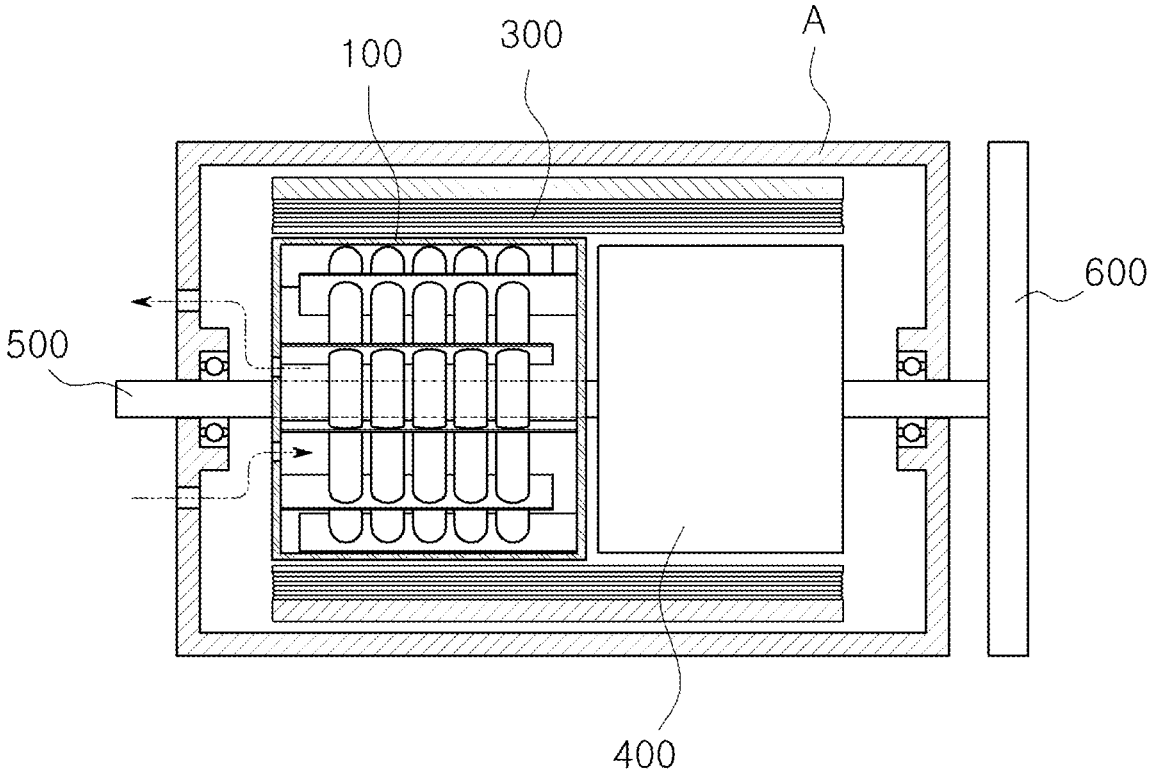

Specifically, as shown in FIG. 9, the rotor 400 may be provided at a side or opposite sides of the heat exchange body 100. Although not shown in the drawing, the rotor may be provided inside the heat exchange body 100 to generate a rotational force. In this case, according to the present invention, it is possible to transmit the rotational force to a load 600 provided at a side or opposite sides of the shaft 500 and to supply hot water or heating at the same time, thereby achieving improved utilization.

For example, the load 600 may be a pump, and the pump may be provided at the side or the opposite sides of the shaft 500. Such a pump may serve to supply water to the inside of the heat exchange body 100, that is, to the heating flow passage 20, by using the rotational force of the rotor 400.

Meanwhile, a usual frequency of an alternating current applied to the stator 300 is 50 Hz or 60 Hz. However, the present invention may further include a regulator for regulating the frequency of the electric current applied to the stator 300, such that a higher or lower frequency than the usual frequency is applied and thus the amount of frictional heat attributable to revolving of the magnetic body 10 is adjusted. In addition, the present invention may further include a temperature sensor capable of directly or indirectly measuring the temperature of water such that the temperature sensor turns ON/OFF the electric current to be applied to the stator 300 in response to a set temperature.

<Description of the Reference Numerals in the Drawings>

| | |
|---|---|
| A: housing | |
| 10: magnetic body | 11: core |
| 12: hole | |
| 20: heating flow passage | |
| 100: heat exchange body | 110: inner cylinder |
| 120: outer cylinder | 130: partition wall |
| 140: circulation hole | 150: cover |
| 151: inlet | 152: outlet |
| 200: heating pipe | 300: stator |
| 400: rotor | 500: shaft |
| 600: load | |

What is claimed is:

1. A hot water supply apparatus using a revolving magnetic body, the apparatus comprising:

a heat exchange body containing water, having a cylindrical shape, and including a circular heating pipe circumferentially provided along an inner circumference of the heat exchange body;

a stator provided to encompass an outside of the heat exchange body and wound with a plurality of coils, the stator being magnetized when an electric current is applied thereto, wherein the heating pipe includes therein a magnetic body that revolves along the circumference of the heating pipe due to a magnetic field formed by the stator, so that water is heated by frictional heat generated when the magnetic body revolves.

2. The apparatus of claim 1, wherein the heat exchange body includes an inner cylinder and an outer cylinder positioned outside the inner cylinder, wherein the water is contained between the inner and outer cylinders and the heating pipe comprises a plurality of annular pipes is arranged in a lengthwise direction of the heat exchange body at a position between the inner and outer cylinders.

3. The apparatus of claim 2, wherein a partition wall is provided between the inner and outer cylinders in the lengthwise direction of the heat exchange body, wherein a plurality of partition walls is arranged in a circumferential direction of the heat exchange body to define heating flow passages.

4. The apparatus of claim 3, wherein the partition walls are provided with circulation holes, respectively, such that water flows to an adjacent heating flow passage, wherein the circulation holes are provided alternately at a first end of each of the partition walls and a second end of an adjacent partition wall.

5. The apparatus of claim 1, wherein the heating pipe includes therein a viscous fluid having viscosity such that the magnetic body efficiently revolves, wherein the viscous fluid includes solid particles such that the frictional heat is increased.

6. The apparatus of claim 5, wherein the magnetic body is provided with a plurality of holes or a plurality of vanes such that a vortex is formed in the viscous fluid.

7. The apparatus of claim 5, wherein the viscous fluid uses heating medium oil and thus is suitable to use for lubrication and heat transfer.

8. The apparatus of claim 1, wherein a plurality of heat exchange bodies is provided inside the stator.

9. The apparatus of claim 1, further comprising:

a regulator regulating frequency of the electric power applied to the stator such that the regulator adjusts the amount of the frictional heat generated by the magnetic body revolving.

10. The apparatus of claim 1, further comprising:

a rotor including a plurality of permanent magnets and rotated by a shaft provided to pass through the heat exchange body in a lengthwise direction thereof, wherein the heat exchange body and the rotor are placed inside the stator.

11. The apparatus of claim 10, wherein a pump is provided at a side of the shaft, the pump supplying water into the heat exchange body using a rotational force of the rotor.

12. The apparatus of claim 1, further comprising:

a temperature sensor measuring a temperature of the water, such that the temperature sensor turns on and off the electric current to be applied to the stator in response to a set temperature.

* * * * *